US009903294B2

(12) United States Patent
Russe et al.

(10) Patent No.: US 9,903,294 B2
(45) Date of Patent: Feb. 27, 2018

(54) METHOD AND DEVICE FOR INJECTING FUEL INTO AN INTERNAL COMBUSTION ENGINE

(71) Applicant: Continental Automotive GmbH, Hannover (DE)

(72) Inventors: Peter Matthias Russe, Tegernheim (DE); Hans-Joerg Wiehoff, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/783,939

(22) PCT Filed: Apr. 14, 2014

(86) PCT No.: PCT/EP2014/057477
§ 371 (c)(1),
(2) Date: Oct. 12, 2015

(87) PCT Pub. No.: WO2014/167134
PCT Pub. Date: Oct. 16, 2014

(65) Prior Publication Data

US 2016/0053704 A1 Feb. 25, 2016

(30) Foreign Application Priority Data

Apr. 12, 2013 (DE) ..... 10 2013 206 600

(51) Int. Cl.
*F02D 41/00* (2006.01)
*F02D 41/20* (2006.01)
(Continued)

(52) U.S. Cl.
CPC ..... *F02D 41/2096* (2013.01); *F02D 41/2467* (2013.01); *F02D 2041/2055* (2013.01); *F02D 2041/286* (2013.01); *F02D 2200/063* (2013.01)

(58) Field of Classification Search
CPC ..... F02P 5/145; F02P 5/153; F02P 5/1512; F02D 41/008; F02D 41/0085;
(Continued)

(56) References Cited

U.S. PATENT DOCUMENTS 5,070,836 A * 12/1991 Wahl ..... F02D 35/023 123/299
6,367,769 B1 4/2002 Reiter et al. ..... 251/129
(Continued)

FOREIGN PATENT DOCUMENTS

CN 102787926 A 11/2012 ..... F02D 41/06
CN 102985670 A 3/2013 ..... F02D 41/22
(Continued)

OTHER PUBLICATIONS

Japanese Office Action, Application No. 2016509442, 6 pages, dated Jun. 27, 2016.
(Continued)

*Primary Examiner* — Hieu T Vo
*Assistant Examiner* — Sherman Manley
(74) *Attorney, Agent, or Firm* — Slayden Grubert Beard PLLC

(57) ABSTRACT

An injection system for an injection system includes at least one injection valve for injecting fuel into an internal combustion engine. A closing element of the injection valve is moved in recurring injection cycles such that the closing element hits an upper stop at an actual opening time and/or hits a closing position at an actual closing time and thereby triggers a characteristic signal of a sensor element of the injection valve, wherein a signal course of the sensor element over time is detected and a part of the signal course contained in a searching time period of the injection system is examined, wherein a searching method is performed in
(Continued)

subsequent injection cycles if the characteristic signal is not detected in said part of the signal course over time.

17 Claims, 5 Drawing Sheets

(51) Int. Cl.
*F02D 41/24* (2006.01)
*F02D 41/28* (2006.01)

(58) Field of Classification Search
CPC .. F02D 41/0027; F02D 19/024; F02D 35/023; F02D 35/028; Y02T 10/46; Y02T 10/32
See application file for complete search history.

(56) References Cited

U.S. PATENT DOCUMENTS

| | | | | |
|---|---|---|---|---|
| 6,520,434 | B1 | 2/2003 | Reiter et al. | 239/585 |
| 6,783,109 | B2 | 8/2004 | Ogura et al. | 251/129 |
| 6,994,281 | B2 | 2/2006 | Reiter | 239/533 |
| 7,073,485 | B2 * | 7/2006 | Truscott | F02D 35/023 123/406.22 |
| 7,139,657 | B2 | 11/2006 | Bouchain et al. | 701/104 |
| 7,506,827 | B2 | 3/2009 | Petrone et al. | 239/585 |
| 7,815,128 | B2 * | 10/2010 | Beilharz | F02D 41/2096 123/299 |
| 8,430,343 | B2 | 4/2013 | Nagatomo | 239/585 |
| 8,620,500 | B2 | 12/2013 | Becker et al. | 701/22 |
| 8,973,893 | B2 * | 3/2015 | Lehner | F02D 41/247 123/490 |
| 2006/0293829 | A1 * | 12/2006 | Cornwell | F02D 35/023 701/114 |
| 2012/0013325 | A1 | 1/2012 | Tonner et al. | 324/104 |
| 2013/0167809 | A1 | 7/2013 | Siedentopf et al. | 123/478 |
| 2013/0255639 | A1 | 10/2013 | Guillen Castillo et al. | 123/472 |
| 2014/0346244 | A1 | 11/2014 | Russe et al. | 239/4 |

FOREIGN PATENT DOCUMENTS

| | | | | |
|---|---|---|---|---|
| DE | 10257686 | A1 | 7/2004 | F02D 41/12 |
| DE | 10305523 | A1 | 8/2004 | F02D 41/22 |
| DE | 10345967 | A1 | 4/2005 | F02M 51/06 |
| DE | 102006048979 | A1 | 4/2008 | F02D 41/20 |
| DE | 102008000587 | A1 | 10/2008 | F02D 41/40 |
| DE | 102008000911 | A1 | 10/2009 | B60W 10/06 |
| DE | 102009000741 | A1 | 8/2010 | H01F 7/18 |
| DE | 102009009270 | A1 | 8/2010 | F02D 41/20 |
| DE | 102010017093 | A1 | 12/2010 | F02D 41/20 |
| DE | 102010021169 | A1 | 11/2011 | F02D 41/00 |
| DE | 102011075732 | A1 | 11/2012 | F02D 41/20 |
| DE | 102011076363 | A1 | 11/2012 | F02M 65/00 |
| EP | 0416265 | A1 | 3/1991 | F02D 41/20 |
| EP | 2527637 | A1 | 11/2012 | F02M 51/06 |
| EP | 2538061 | A2 | 12/2012 | F02D 41/20 |
| JP | 2010096075 | A | 4/2010 | F02M 51/06 |
| JP | 2011137442 | A | 7/2011 | F02M 51/06 |
| JP | 2011190798 | A | 9/2011 | F02M 51/06 |
| JP | 2012172594 | A | 9/2012 | F02M 51/06 |
| WO | 02/084102 | A1 | 10/2002 | F02M 51/06 |
| WO | 03/081007 | A1 | 10/2003 | F02D 41/20 |
| WO | 2004/074673 | A1 | 9/2004 | F02M 51/06 |
| WO | 2009/019584 | A2 | 2/2009 | B60K 6/24 |
| WO | 2012/076561 | A1 | 6/2012 | B60W 10/08 |
| WO | 2014/167134 | A1 | 10/2014 | F02D 41/20 |
| WO | 2014/173742 | A1 | 10/2014 | F02D 41/12 |
| WO | 2014/173920 | A1 | 10/2014 | F02M 51/06 |

OTHER PUBLICATIONS

European Search Report, Application No. 13165546.6, 8 pages, dated Oct. 14, 2013.
German Office Action, Application No. 102013206600.7, 7 pages, Dec. 12, 2013.
German Office Action, Application No. 102013207555.3, 5 pages, Jan. 23, 2014.
International Search Report and Written Opinion, Application No. PCT/EP2014/057477, 20 pages, dated Aug. 7, 2014.
International Search Report and Written Opinion, Application No. PCT/EP2014/057680, 18 pages, dated Aug. 11, 2014.
Chinese Office Action, Application No. 201480020859.7, 16 pages, Feb. 28, 2017.
U.S. Non-Final Office Action, U.S. Appl. No. 14/785,914, 30 pages, dated Jul. 6, 2017.

* cited by examiner

METHOD AND DEVICE FOR INJECTING FUEL INTO AN INTERNAL COMBUSTION ENGINE

CROSS-REFERENCE TO RELATED APPLICATIONS

This application is a U.S. National Stage Application of International Application No. PCT/EP2014/057477 filed Apr. 14, 2014, which designates the United States of America, and claims priority to DE Application No. 10 2013 206 600.7 filed Apr. 12, 2013, the contents of which are hereby incorporated by reference in their entirety.

TECHNICAL FIELD

The invention relates to a control method for an injection system having at least one injection valve for injecting fuel into an internal combustion engine. The invention also relates to a corresponding injection system.

BACKGROUND

Control methods are known for actuating the injection valve(s) of an injection system in recurring injection cycles in such a way that in each of these injection cycles the injection valve is opened and closed again in such a way that a pressurized fuel is injected into the internal combustion engine as precisely as possible with a previously determined profile over time of an injection rate.

Since the actual profiles over time of the injection rates and therefore also the respectively actually injected quantities of fuel depend, in particular, on the actual opening times and closing times of the injection valves, the opening times and/or the closing times of the injection valves are measured by means of a sensor element with a control method of the generic type and/or with an injection system of the generic type, and the measured opening times and/or the measured closing times are subsequently taken into account in the actuation of the injection valves in the subsequent injection cycles, in order to monitor and/or reduce control errors of one or more control variables of the injection method. For example, the opening time and also the closing time can be control variables of the control method. The setpoint opening time and/or the setpoint closing time are/is typically determined as a function of an instantaneously required injection quantity and/or as a function of an instantaneously required profile over time of the injection rate.

An injection valve, frequently also referred to as an injector, comprises a closure element which can be configured, for example, as a nozzle needle, and an actuator with which the closure element can be moved between a closed position and an upper stop. If the closure element is in the closed position, the injector is closed and no fuel injection takes place. In the closed position, the closure element is typically seated on a lower stop of the injection valve and closes all the injection openings of the injection valve. In order to open the injector, the closure element is raised from the closed position by means of the actuator, with the result that in this way one, more than one, or each of the injection openings is/are opened and the injection of the fuel takes place through the opened injection openings. The closure element can be raised at maximum up to the specified upper stop which therefore defines a maximum stroke height of the closure element relative to the closed position or to the lower stop. In the text which follows, the opening time is to be understood as that time at which the closure element impacts against the upper stop (attaining of the maximum needle stroke), and the closing time is to be understood as that time at which the closure element impacts in the closed position, that is to say against the lower stop. Further characterizing times of an injection cycle are the time at which the closure element leaves the closed position, and the time at which the closure element leaves the upper stop. (Start of the closing movement given a maximum stroke height). According to their time sequences, these times are denoted by OPP1, OPP2, OPP3 and OPP4.

In order to be able to measure the opening time and/or the closing time (OPP2 and/or OPP4), the injection valve comprises a sensor element in which characteristic signals are triggered by the impacting of the closure element in the closed position or against the upper stop. In order to be able to detect these characteristic signals, which are correspondingly also referred to as opening signals or as closing signals of the sensor element, a signal profile over time of the sensor element is detected and evaluated. This generally involves buffering of the signal profile over time. Generally, known injection systems or injection valves have for this purpose data memories whose memory capacity is, however, typically not sufficient to detect a total profile over time of output signals of the sensor element. However, for this reason or else for other reasons such as, for example, in order to accelerate and/or simplify the subsequent data evaluation, the entire signal profile over time of the sensor element is not stored, and the presence of the characteristic signals is subsequently examined, but instead examination is carried out only of parts of the signal profile over time which are contained in one or more predefined time search windows. In this context, these search windows are selected in such a way that they contain the expected closing time and/or the expected opening time of a given injection cycle.

However, if the actual closing time or the actual opening time is chronologically outside the respective search window for a given injection cycle, it is generally not possible to detect the associated characteristic signals and to acquire the opening time or the closing time. Non-detection of the characteristic signal is also referred to in the text which follows as a loss of the characteristic signal or of the closing signal or of the opening signal or is referred to in brief as a control loss. Such a control loss may lead, for example, to a situation in which the injection system can subsequently only continue to be operated in an emergency running mode.

The problem therefore arises of improving the reliability and the robustness of known control methods and injection systems. In particular, the measurement of the opening and closing times of the injection valves is to be improved.

SUMMARY

One embodiment provides a control method for an injection system having at least one injection valve for injecting fuel into an internal combustion engine, wherein a closure element of the injection valve is moved in recurring injection cycles by means of an actuator of the injection valve as a function of an actual value of a manipulated variable of the injection valve, wherein the closure element impacts against an upper stop at an actual opening time and/or impacts in a closed position at an actual closing time, wherein, when the closure element is in the closed position or impacts against the upper stop, it triggers a characteristic signal of a sensor element of the injection valve, wherein during at least one of the injection cycles a signal profile over time of the sensor element is detected and a part of the signal profile which is contained in a time search window of the injection cycle is examined for the presence of the characteristic signal, wherein the time search window of this injection cycle is selected in such a way that it contains an expected opening time at which the impacting of the closure element against the stop is expected, or an expected closing time at which the impacting of the closure element in the closed position is expected, wherein, insofar as the characteristic signal is detected in the specified part of the signal profile over time, the actual opening time and/or the actual closing time of this injection cycle is acquired on the basis of the characteristic signal, wherein the actual value of the manipulated variable of the injection valve for a subsequent injection cycle is determined as a function of the acquired actual opening time and/or as a function of the acquired actual closing time, and wherein, insofar as the characteristic signal is not detected in the specified part of the signal profile over time for this injection cycle, in subsequent injection cycles a searching method is carried out, wherein a starting value for the manipulated variable of this injection valve is defined for this searching method, wherein the actual value of the manipulated variable is acquired for each of these subsequent injection cycles as the sum of this starting value and an incremental value which is associated with this subsequent injection cycle, wherein the incremental values of the subsequent injection cycles increase in absolute terms in the course of the searching method.

In a further embodiment, the incremental values of the subsequent injection cycles change their sign in the course of the searching method.

In a further embodiment, the actuator of the injection valve has a drive which is configured as a piezo element.

In a further embodiment, the sensor element of the injection valve is the piezo element of the actuator of the injection valve.

In a further embodiment, the characteristic signal of the sensor element is a fluctuation in an electrical measurement variable.

In a further embodiment, the manipulated variable of the injection valve is an actuation time of the actuator, a start of charging of the actuator, a start of discharging of the actuator, a charging period of the actuator, a current strength or a voltage or contains a combination of a plurality of these variables.

In a further embodiment, the actual value of the manipulated variable of a preceding injection cycle of this injection valve is used as starting value of the searching method.

In a further embodiment, the starting value of the searching method corresponds to a reference calibration, permanently predefined for this injection valve, of the injection valve.

In a further embodiment, the starting value of the searching method is acquired taking into account, and as a function of, actual values of manipulated variables of further injection valves of the injection system.

In a further embodiment, a mean value of the actual values of manipulated variables of the further injection valves is formed, and the starting value of the searching method is determined on the basis of this mean value.

In a further embodiment, for each of the injection cycles, in addition to the first-mentioned time search window a further time search window is provided which is chronologically separated from the first-mentioned search window, wherein the first-mentioned search window is selected in such a way that it comprises the expected opening time of the injection cycle, wherein the further search window is selected in such a way that it comprises the expected closing time of the injection cycle, wherein in addition a further part of the signal profile over time of the sensor element, which is detected during this injection cycle, is examined for the presence of the characteristic signals, wherein the specified further part of the profile over time is contained in the further time search window of this injection cycle, wherein, insofar as the characteristic signals are detected in the specified further part of the signal profile over time, the actual closing time of this injection cycle is acquired on the basis of this characteristic signal, wherein the actual value of the manipulated value of the injection valve for a subsequent injection cycle is acquired as a function of the actual closing time, wherein, insofar as the characteristic signals are not detected in the specified further part of the signal profile over time, in subsequent injection cycles a further searching method is carried out, wherein for this further searching method a further starting value for the manipulated variable of this injection valve is defined, wherein the actual value of the manipulated variable is acquired for each of these subsequent injection cycles as the sum of this further starting value and of a further incremental value which is associated with this subsequent injection cycle, wherein the further incremental values of the subsequent injection cycles increase in absolute terms in the course of the further searching method.

In a further embodiment, the further incremental values change their sign alternately.

In a further embodiment, the expected opening time is acquired as a function of the actual opening time of a preceding injection cycle and/or in that the expected closing time is acquired as a function of the actual closing time of a preceding injection cycle.

In a further embodiment, for the expected opening time is a setpoint opening time and/or the expected closing time is a setpoint closing time, wherein the actual value of the manipulated variable is selected in such a way that the actual opening time corresponds as precisely as possible to the setpoint opening time and/or in that the actual closing time corresponds as precisely as possible to the setpoint closing time.

Another embodiment provides an injection system, comprising at least one injection valve for injecting fuel into an internal combustion engine, wherein the injection valve comprises a closure element for closing the injection valve and an actuator for moving the closure element between an upper stop and a closed position of the closure element, wherein the injection system has a sensor element in which characteristic signals can be triggered by impacting of the closure element against the upper stop at an actual opening time and/or by impacting of the closure element in a closed position at an actual closing time, wherein the injection system comprises a control unit which is configured to actuate the actuator of the injection valve in recurring injection cycles and as a function of an actual value of a manipulated variable of the injection valve to move the closure element, wherein the control unit is configured to examine, for each of the injection cycles of the injection valve, a part of a signal profile over time of the sensor element for the presence of the characteristic signal, wherein the specified part of the signal profile over time is contained in a time search window of this injection cycle, wherein the time search window is selected such that it additionally contains an expected opening time or an expected closing time, wherein the control unit is configured to acquire the actual opening time and/or the actual closing time of this injection cycle on the basis of the characteristic signal, insofar as the characteristic signal can be detected in the specified part of the signal profile over time, wherein the control unit is also configured to acquire the at least one actual value of the at least one manipulated variable of the injection valve for a subsequent injection cycle as a function of the acquired actual opening time and/or as a function of the acquired actual closing time, wherein the control unit is configured, insofar as the characteristic signals in the specified part of the signal profile over time cannot be detected for this injection valve, to carry out a searching method in subsequent injection cycles and to define a starting value for the manipulated variable of this injection valve for this searching method and to acquire the actual value of the manipulated variable for each of these subsequent injection cycles as the sum of this starting value and of an incremental value which is associated with this subsequent injection cycle, wherein the incremental values of the subsequent injection cycles increase in absolute terms in the course of the searching method.

In a further embodiment, the incremental values of the subsequent injection cycles have alternating signs.

In a further embodiment, the actuator of the injection valve has a drive which is configured as a piezo element.

In a further embodiment, the sensor element of the injection valve is the piezo element of the actuator of the injection valve.

In a further embodiment, the characteristic signal of the sensor element is a fluctuation in an electrical measurement variable.

In a further embodiment, the control unit is configured to carry out a method as disclosed above.

BRIEF DESCRIPTION OF THE DRAWINGS

Example embodiments of the invention are explained in more detail below with reference to the drawings, in which.

DETAILED DESCRIPTION

Figure 1:
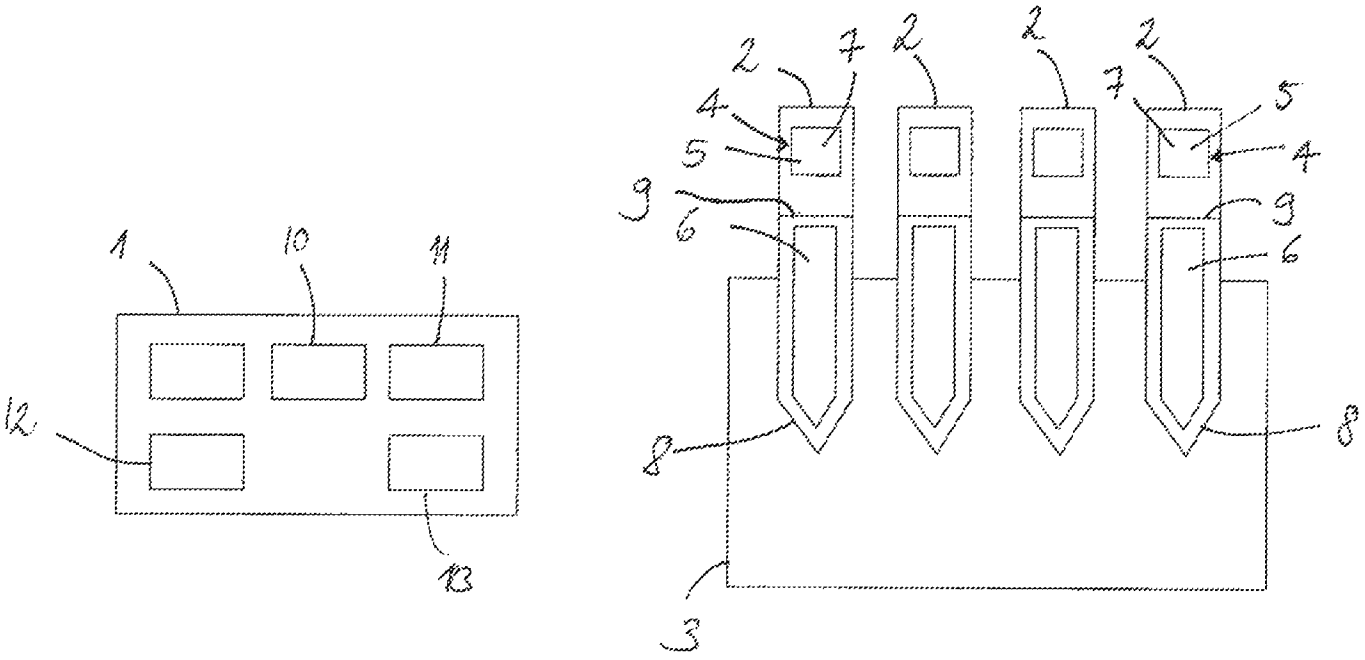
FIG. 1 shows an injection system according to an embodiment.

Embodiments of the invention provide a control method an injection system.

Some embodiments provides a control system for an injection system having at least one injection valve for injecting fuel into an internal combustion engine, in particular for an injection system of the type proposed here, a closure element of the injection valve is moved in recurring injection cycles by means of an actuator of the injection valve as a function of an actual value of a manipulated variable (that is to say what is referred to as the actual manipulated value) of the injection valve. The closure element impacts against an upper stop of the injection valve at an actual opening time and/or impacts in a closed position (against a lower stop) of the injection valve at an actual closing time. The moment at which the closure element impacts in the closed position or against the upper stop, a characteristic signal is triggered by means of a sensor element of the injection valve.

During at least one of the injection cycles (and typically during a plurality thereof or even during each injection cycle) a signal profile over time of the sensor element is detected and a part of the signal profile which is contained in a time search window of the injection cycle is examined for the presence of the characteristic signal. The time search window is shorter than the injection cycle and is selected in such a way that it contains an expected opening time at which the impacting of the closure element against the stop is expected, and/or an expected closing time at which the impacting of the closure element in the closed position is expected. As is described further below, two (or more) time windows which are chronologically separated from one another can also be provided per injection cycle, one of which time windows contains, for example, the expected opening time, and a further one of which contains the expected closing time.

Insofar as the characteristic signal is detected in the specified part of the signal profile over time, the actual opening time and/or the actual closing time of this injection cycle is acquired on the basis of the characteristic signal. The actual value of the manipulated variable of the injection valve for one of the subsequent injection cycles is subsequently determined as a function of the acquired actual opening time and/or as a function of the acquired actual closing time, typically with the proviso of the reduction in a control error. The formulation "as a function" can be understood as meaning, for example, "using", "according to the evaluation of", or "on the basis of". In this context, one variable typically serves as the basis for the determination, calculation or acquisition of another variable.

The specified manipulated variable of the injection valve may be, for example, an actuation time of the actuator, a start of charging of the actuator, a start of discharging of the actuator, a charging duration of the actuator, a current strength or a voltage with which the actuator is energized or actuated. However, it is also possible for the manipulated variable to be multi-dimensional, that is to say to be provided by means of an actuation vector whose inputs are provided by one or more of the specified manipulated variables. The actual value of the control vector is understood therefore to be the actual values of its inputs.

For example, it is possible that the expected opening time is acquired as a function of the actual opening time of a preceding injection cycle, and/or that the expected closing time is acquired as a function of the actual closing time of a preceding injection cycle. As has been described at the beginning, it is possible to provide that the expected opening time is a setpoint opening time, and that the opening time therefore constitutes a control variable. Additionally or alternatively, it is possible that the expected closing time is a setpoint closing time, that is to say that the closing time constitutes a control variable. In this case, in order to reduce the control error the actual value of the control variable is selected such that the actual opening time corresponds as precisely as possible to the setpoint opening time and/or that the actual closing time corresponds as precisely as possible to the setpoint closing time, that is to say that corresponding control errors are minimized. In this case, the difference between the actual closing time and the setpoint closing time, or the difference between the actual opening time and the setpoint opening time, is used as a control error of the control method. This means that the actual value of the control variable of a subsequent injection cycle is corrected as a function of the control error associated with a given injection cycle, that is to say the difference between the actual closing time and the setpoint closing time (or the actual opening time and the setpoint opening time), in such a way that the control error is reduced.

The actuator of the injection valve can be configured, for example, as a piezo actuator, and can have a piezo element as a drive. Piezo actuators, in particular directly driven piezo actuators, such as are described, for example, in EP 1 760 305 A1, are particularly well suited for precise and delay-free movement of the closure element. Alternatively, the actuator can also have a magnetic drive which can comprise for this purpose, for example, a magnetic coil and a permanent magnet.

The drive of the actuator, that is to say, for example, the piezo element or magnetic drive of the actuator, is preferably also simultaneously used as the sensor element. In the case of a piezo element, the specified signal profiles over time can be, for example, electrical current signals and/or electrical voltage signals which are tapped at the piezo element. Correspondingly, in the case of a magnetic drive induced currents and/or induced voltages in the coil can serve as the signal profile over time and be correspondingly tapped and evaluated. It is also possible that profiles over time of further (typically electrical) measurement variables which characterize, for example, an instantaneous state of the injection valve, of the actuator, of the drive of the actuator and/or of the closure element, are acquired using the signal profile over time of the sensor element. For example in the case of the piezo element these may be, for example, an electrical capacitance, an amount of electrostatic energy stored in the piezo element, a charging current strength, a discharging current strength or an electrical voltage of the piezo element, or a further variable which is acquired from these measurement variables. When the closure element impacts in the closed position or against the upper stop, characteristic fluctuations occur in these measurement variables, which can therefore serve as the characteristic signals for determining the closing time and/or the opening time of the respective injection valve.

In some embodiments, it is then decisive that, insofar as the characteristic signal in the specified part of the signal profile over time which is therefore contained in the specified search window is not detected for a given injection cycle, that is to say a control loss has occurred, a searching method, described in the text which follows, is carried out in subsequent injection cycles. This searching method is carried out until the lost characteristic signal has been found again in one of these subsequent injection cycles (and the control method can be resumed) or an abort criterion is satisfied (and typically an emergency running program is executed).

At the start of the proposed searching method, a starting value for the manipulated variable or for the actuating vector (the starting value can then also be a vector) of this injection valve is firstly defined. The actual value of the manipulated variable with which the actuator is actuated is subsequently changed for each of these subsequent injection cycles of the searching method on the basis of this starting value in that an incremental value or an increment vector is added to the starting value. In the event of the manipulated variable being a multi-dimensional actuating vector, it is typically provided that only one component of this actuating vector is varied in the searching method, while the actual values of the other components of the actuator vector are not changed. Accordingly, the increment vector then has precisely one non-negligible entry. For the sake of simplicity here linguistic differentiation is not always made between the uni-dimensional and multi-dimensional cases. Insofar, therefore, as a manipulated variable, an actual value, starting value, incremental value etc. are mentioned, the intention is therefore always to refer to the respectively corresponding vectorial variable, that is to say correspondingly the actuating vector, the vectorial actual value thereof, the starting vector, the increment vector, etc.

For each of the injection cycles during the searching method, the actual value of the manipulated variable is now acquired as the sum of this starting value and of an incremental value which is associated with precisely this injection cycle. The specified sum is therefore formed from the fixed starting value, $S_{start}$, and the precisely one incremental value, $I_n$, of this injection cycle. Therefore, precisely one incremental value $I_n$ is associated with each of the injection cycles of the searching method, wherein the index n is the value of an iterator of the searching method. The iterator can be defined, for example, in such a way that its value n, starting at "0" or "1" at the start of the searching method is increased by "1" after each injection cycle of the searching method. The incremental values $I_n$ of the injection cycles during the searching method can therefore also be defined as functional values of a function of the value n of the iterator. By means of the iterator, an abort criterion for the searching method can also be defined as an upward transgression of a predefined maximum value for the iterator, $n>n_{max}$.

For the proposed searching method it is decisive that the incremental values $I_n$ of the injection cycles of the searching method are defined in such a way that their absolute values increase monotonously or even strictly monotonously in the profile over time of the searching method. The absolute values of the incremental values can therefore be defined as a monotonously or strictly monotonously increasing function of the value n of the iterator.

The proposed searching method permits the lost closing signal or opening signal to be found again very quickly and with a high level of reliability, therefore making it possible to avoid an emergency running program of the injection system in most cases. After the opening signal and the closing signal has been found again, the control method can advantageously be resumed and continued with the actual value of the control variable which has been acquired last in the searching method. This is also referred to in the following text as resumption of the control method (after a preceding control loss). One-time renewed detection of the closing signal in this way after the loss of the closing signal or of the opening signal after the loss of the opening signal is also referred to as refinding of the characteristic signal or of the closing signal or of the opening signal.

A loss of the characteristic signal, that is to say control loss, is typically caused by the fact that the actual opening time or the actual closing time in the respective injection cycle is chronologically so far from the expected actual opening time or actual closing time that it is outside the time search window or windows of this injection cycle.

For the proposed searching method, the technical cause of the control loss advantageously generally plays only a subordinate role. Technical causes are, for example, aging processes or wear processes of the injection valve which typically change the opening behavior and/or the closing behavior in such a way that the closing time (given the same actuation) is increasingly brought forward. However, even new injection valves, which have therefore only recently been put into operation, for example after the replacement of a defective injection valve or in the case of the injection system or the internal combustion engine being first put into service, frequently have a strong drift behavior in their opening and closing characteristics. A further advantage of the control method is therefore also that it permits more generous tolerance limits with respect to a reference behavior for injection valves, in particular with respect to their drift behavior. In addition, for the proposed control method relatively large tolerance limits are frequently also possible for other components of the injection system which is used, in particular for components of the control unit of the injection system such as, for example, of controllers and output stages for generating control signals.

An alternative or additional abort criterion may be provided, for example, by virtue of the fact that the actual value of the manipulated variable or a component of the vectorial actual value of the actuating vector exceeds an upper threshold value or undershoots a lower threshold value during the searching method.

In a further development which permits particularly reliable refinding of the characteristic signal, it is provided that the incremental values in the course of the searching method continuously change their sign in the course of the searching method, if appropriate therefore as the value n of the iterator increases. This changing of the sign of the incremental value (or of the components of the incremental vector) can occur, for example, in such a way that the incremental values of two directly successive injection cycles respectively differ in their sign, and therefore that the sign of the incremental values changes after each injection cycle of the searching method. It is also possible that the sign changes not in every injection cycle but only after each second injection cycle or generally after each j-th injection cycle (j is a natural number such as, for example, 1, 2, 3 . . . ) in such a way that precisely two directly successive injection cycles will therefore always have incremental values with the same sign, or generally precisely j successive injection cycles will always have incremental values with the same sign. However, j is preferably not greater than 5, preferably ≤3.

Increasing the incremental values in absolute terms and at the same time changing the sign of the incremental values varies the manipulated variable on the basis of the described starting value in such a way that the refinding of the characteristic signal advantageously functions independently of the actual closing time or actual opening time is before or after the searching window of the injections signal. There is therefore, in particular, an independence of the direction of the drift of the opening characteristic and closing characteristic of a given injection valve, which direction can itself be dependent, for example, on the type of wear or on the specific embodiment of the injection valve.

There are various possibilities for the determination of the starting value of the manipulated variable at the start of the searching method. On the other hand, it is possible to use as the starting value of the searching method the actual value of the manipulated variable of one of the preceding injection cycles of this injection valve, at which the characteristic signal has been detected, that is to say before the control loss. For example it can be provided that the actual values of the manipulated variables are stored and, for example, the actual value of the manipulated variable of that injection cycle of the preceding injection cycles at which the characteristic signal was last able to be detected, that is to say directly before the control loss, is used. Agreement or relative correspondence between the setpoint values of the control method, that is for example a corresponding profile over time of the injection rate, a corresponding injection period, a corresponding setpoint closing time, a corresponding setpoint opening time etc. can also be used as an additional or alternative criterion. Alternatively or additionally, it is possible to provide that the starting value of the searching method corresponds to a reference calibration, permanently predefined for this injection valve, of the injection valve (and, for example, stored in a corresponding memory). In this context it is possible for the reference calibration to be present in the form of a reference characteristic diagram, and for the starting value therefore to depend on an instantaneous working point of the injection valve (that is to say the instantaneous setpoint value or values of the control variable or variables of the control method). For example, it is possible, for instance in the event of the closing time (OPP4) being a control variable of the control method (closing time controller), for a chronological start and/or a chronological end of the search window to be calculated as a function of a plurality of parameters which can each be stored in a characteristic diagram and read out therefrom, such as, for example, an electrical injection period ("TI characteristic diagram"), the setpoint value of the closing time (OPP4 setpoint value characteristic diagram) and a time interval between the setpoint value of the closing time (OPP4) and the chronological start and/or end of the search window. The (electrical) injection period (TI or $T_c$) can be defined, for example, as a charging period of the (piezo) actuator or else as the time interval between the actuation of the actuator for opening the injection valve and actuation of the actuator for closing the injection valve.

The injection valve typically comprises a plurality of injection valves, such as, for example, four, six, eight or twelve injection valves, wherein each of these injection valves is actuated and controlled with the control method proposed here. The starting value of the searching method can then be acquired taking into account, and as a function of, the instantaneous actual values of the manipulated variables of the further injection valves of the injection system. For example it is possible to form a mean value of these actual values and to define the starting value of the searching method on the basis of this mean value or as this mean value.

In the event of the manipulated variable being a multidimensional actuating vector, typically, as described above, just one component of this actuating vector is varied in the searching method, while the actual values of the other components of the actuating vector are not changed. For example, in the searching method only the charging current strength, only the charging period, only the actuation time, only the start of charging, only the start of discharging, only the charging voltage, only the control current or only the control voltage are varied, while the other inputs or components of the actuating vector are kept constant. In this context, there can be provision that in the event of a loss of the opening signal another component of the control vector is varied and in the case of a loss of the closing signal. In the case of the loss of the closing signal, it is possible, for example, to vary the (electrical) injection period (TI or $T_c$), and in the event of a loss of the opening signal it is possible, for example, to vary the charging current strength $I_c$. It is, of course, also possible that a plurality of, or even all of, the manipulated variables are varied, for example if a variable which is derived from the manipulated variables is to be varied, such as, for example, an amount of (electrical) energy E of the (piezo) actuator. As has already been described, the opening signal in the event of bouncing of the closure element (the needle) in the upper stop is detected. The time of the impacting is dependent, in particular, on the amount of energy E which is transmitted to the closure element by the drive. In the case of a piezo actuator with the electrical capacitance C, approximately the electrostatic energy of the piezo actuator can be used for the transmitted energy, for which approximately the relationship $E=\frac{1}{2}*Q*U=\frac{1}{2}*Q*Q/C=\text{integral } (I(t)*dt)^2/(2C)$ applies, where I(t) is the profile over time of the charging current strength and the integral is typically implemented over the charging period. In order to calculate the electrostatic energy the (discrete) approximation $E=\text{sum } (I(n)*\Delta t(n))^2/(2C)$ is typically used. The search for the opening signal by varying the manipulated variable of the (electrical) injection time or charging period (TI or $T_c$) can be carried out by varying the manipulated variable of the charging current $I_c$ or by (simultaneously) varying both of these control variables.

As well as the first-mentioned time search window, it is possible to provide additionally for each of the injection cycles a further time search window which is chronologically separated from the first-mentioned search window. The first-mentioned search window is typically selected in such a way that it comprises the expected opening time of the injection cycle, and the further search window is selected in such a way that it comprises the expected closing time of the injection cycle. In addition to the first-mentioned part of the signal profile over time of the sensor element, which is detected during this injection cycle, a further part is also examined for the presence of the characteristic signal, wherein the specified further part of the profile over time is contained in the further time search window of this injection cycle. Insofar as the characteristic signals are detected in the specified further part of the signal profile over time, the actual closing time of the respective injection valve is acquired for the respective injection cycle on the basis of, and as a function of, these detected characteristic signals.

It is therefore possible to acquire in this way both the actual opening time (on the basis of the detected characteristic signals in the first-mentioned part of the signal profile over time) and the actual closing time (on the basis of the detected characteristic signals in the further part of the signal profile over time). On the basis of this information it is possible, for example, to use both the opening time and the closing time as control variables of the control method.

However, insofar as the characteristic signals are not detected in the specified further part of the signal profile over time, in subsequent injection cycles a further searching method is carried out which corresponds to the description of the first-mentioned searching method. In particular, for this further searching method a further starting value for the manipulated variable of this injection valve is therefore defined, wherein the actual value of the manipulated variable is in turn, as described, acquired for each of these subsequent injection cycles as the sum of this further starting value and of a further incremental value which is associated with this subsequent injection cycle. As has already been explained in relation to the first-mentioned incremental values, the absolute values of the further incremental values of the subsequent injection cycles also increase in the course of the further searching method and can also change their sign alternately. Likewise, all the developments and embodiments which are described in relation to the first-mentioned searching method can also be transferred to the further searching method.

The disclosed injection system for injecting fuel into an internal combustion engine can be configured or equipped to carry out a control method of the type proposed here.

An injection system of the type proposed here comprises at least one injection valve for injecting fuel into an internal combustion engine. For the at least one injection valve, the descriptions which have already been given in relation to the method proposed here apply. The injection system also comprises a control unit which is configured to actuate the actuator of the at least one injection valve in recurring injection cycles and as a function of an actual value of a manipulated variable of the injection valve to move the closure element of the injection valve between the closed position and the upper stop, so as to open and close the injection valve as described. The control unit is also configured to examine, for each of the injection cycles of the respective injection valve, a part of a signal profile over time of the sensor element of the injection valve for the presence of the characteristic signal, as is described in conjunction with the proposed control method, wherein the specified part of the signal profile over time is contained in a time search window of this injection cycle. With respect to the time search window, reference is made again to the corresponding statements relating to the method proposed here. The control unit is also configured to acquire the actual opening time and/or the actual closing time of this injection cycle on the basis of the characteristic signal, insofar as the characteristic signal can be detected in the specified part of the signal profile over time and to acquire the at least one actual value of the at least one manipulated variable of the injection valve for a subsequent injection cycle as a function of the acquired actual opening time and/or as a function of the acquired actual closing time. Reference is also made here to the statements relating to the proposed control method.

The control unit is also configured, insofar as the characteristic signals in the specified part of the signal profile over time cannot be detected for this injection valve, to carry out the searching method which has already been described above in relation to the control method proposed here in subsequent injection cycles, and to define a starting value for the manipulated variable of this injection valve for this searching method and to acquire the actual value of the manipulated variable for each of these subsequent injection cycles as the sum of this starting value and of an incremental value which is associated with this subsequent injection cycle, wherein the incremental values of the subsequent injection cycles increase in absolute terms in the course of the searching method, and in one specific embodiment of the injection system they also change their sign.

In this way, the advantages already described in relation to the control method proposed here can take effect. The developments of the invention which are described in relation to the proposed control method can be correspondingly also transferred to the injection system. In particular, the at least one injection valve can therefore have a drive which is configured as a piezo element. The sensor element in turn can be provided by the drive of the injection system, that is to say, in particular, by the specified piezo element in the case of a piezo actuator.

FIG. 1 shows a schematic illustration of an injection system of the type proposed here, which is configured to implement a specific embodiment of a control method of the type proposed here. The injection system comprises a control unit 1 and a plurality of injection valves 2 for injecting a fuel into an internal combustion engine 3. In principle it is possible that the injection system is a common rail injection system. The fuel can be, for example, diesel, and the internal combustion engine can be, for example, a diesel engine. However, in principle it is also possible that the fuel is gasoline or some other fuel, and the internal combustion engine 3 is, for example, a spark ignition engine. The internal combustion engine 3 can be, for example, the drive engine of a vehicle, for example a passenger car.

In the example shown, the injection valves 2 are configured as piezo injectors, and they therefore each comprise an actuator 4 with a piezo element 5 as a drive for moving a closure element 6 of the respective injection valve 2. The piezo elements 5 of the injection valves 2 serve at the same time as sensor elements 7 in which characteristic signals are triggered as soon as the closure element 6 impacts in a closed position 8 (or against a lower stop) or against another stop 9 of the respective injection valve 2. In the present example, the injection valves are configured as directly driven piezo injectors, but they can equally well be configured as servo injectors. Instead of a piezo injector, the injection valves 2 could, however, also be equipped with magnetic actuators, the drives of which comprise, for example, in each case a coil and a permanent magnet as a drive. The drive could then also at the same time serve as a sensor element 7, as described above.

Figure 2:
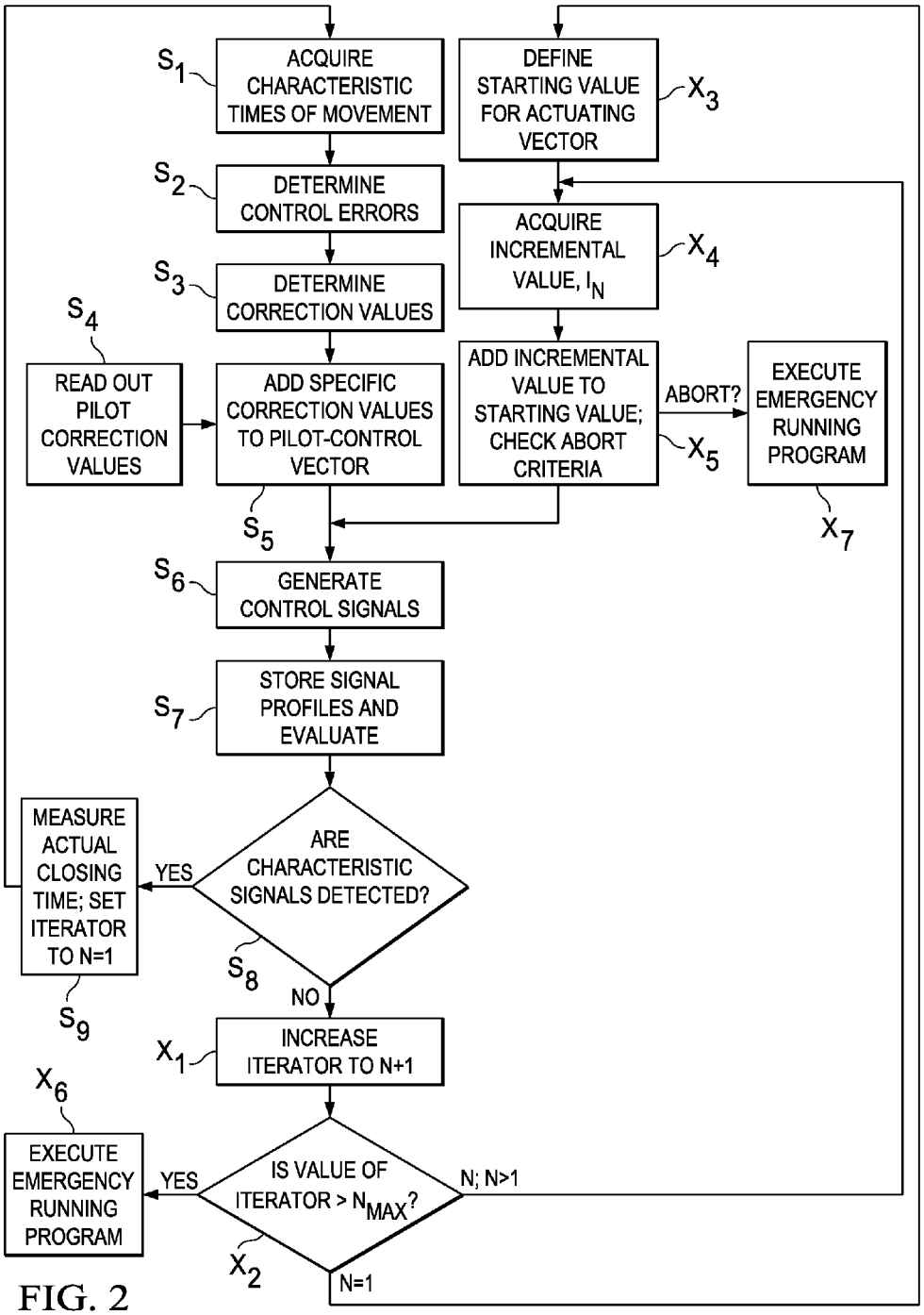
FIG. 2 shows a flowchart of a control method according to an embodiment.

The control unit 1 is configured to actuate the injectors 2 in each case in recurring injection cycles by means of control signals. The control signals may be charging currents or discharging currents with predefined current strengths and predefined charging periods or discharging periods and start of charging times and start of discharging times. These variables are therefore control variables which are combined in a control vector. These control signals are generated according to one specific embodiment of the control method proposed here, for example as illustrated schematically in the flowchart shown in FIG. 2.

The control method is carried out for each of the injection valves 2 by means of the control unit shown in FIG. 1. The following description therefore relates to each of these injection valves 2.

Figure 3:
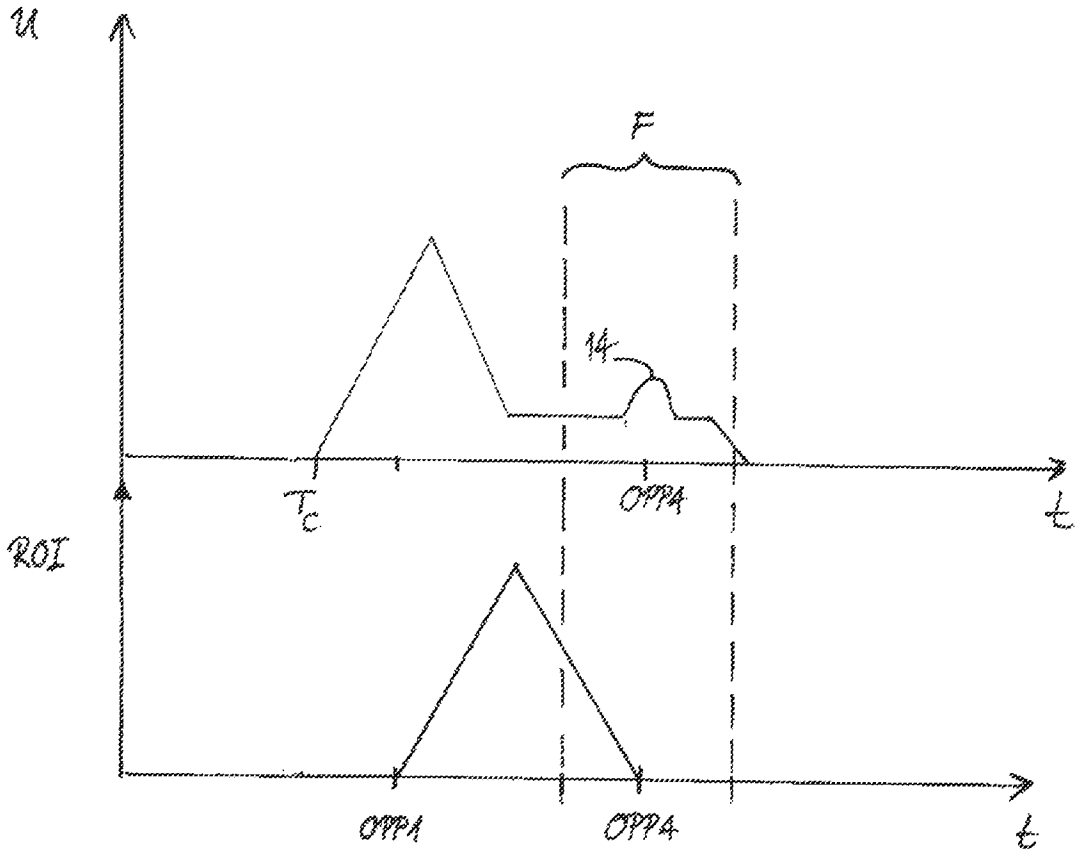
FIG. 3 shows a signal profile over time, generated by means of a sensor element of an injection system according to an embodiment.

In step S1, as a function of an instantaneously required injection quantity and an instantaneously required profile over time of an injection rate (ROI, measured as a volume of fuel per unit of time), characteristic times of the movement of the closure element 6 which is required for this are acquired by means of a computing unit 10 of the control unit 1. Associated with these times are the start of opening (OPP1), at which the closure element starts to move out of the closed position 8 and to open the injection openings (not illustrated here) of the injection valve 2, if appropriate the already described opening time (OPP2), at which the closure element 6 impacts against the upper stop 9 (so far as this is provided, cf. FIGS. 3 and 4), if appropriate the start of the closing movement (OPP3), at which the closure element 6 moves back to the closed position 8 from the upper stop 9, and the already described closing time (OPP4), at which the closure element 6 impacts again in the closed position 8. Two different examples of possible required profiles over time of the injection rate (ROI) are illustrated schematically in FIGS. 3 and 4, and the associated characteristic times (OPP1 to OPP4) are entered. The example shown in FIG. 3 is concerned with what is referred to as a ballistic injection in which the closure element 6 does not strike against the upper stop 9 but instead is raised only as far as underneath the upper stop. In this case, the two times OPP2 and OPP3 are accordingly eliminated, wherein the closing time (OPP4) constitutes a control variable of the control method.

Figure 4:
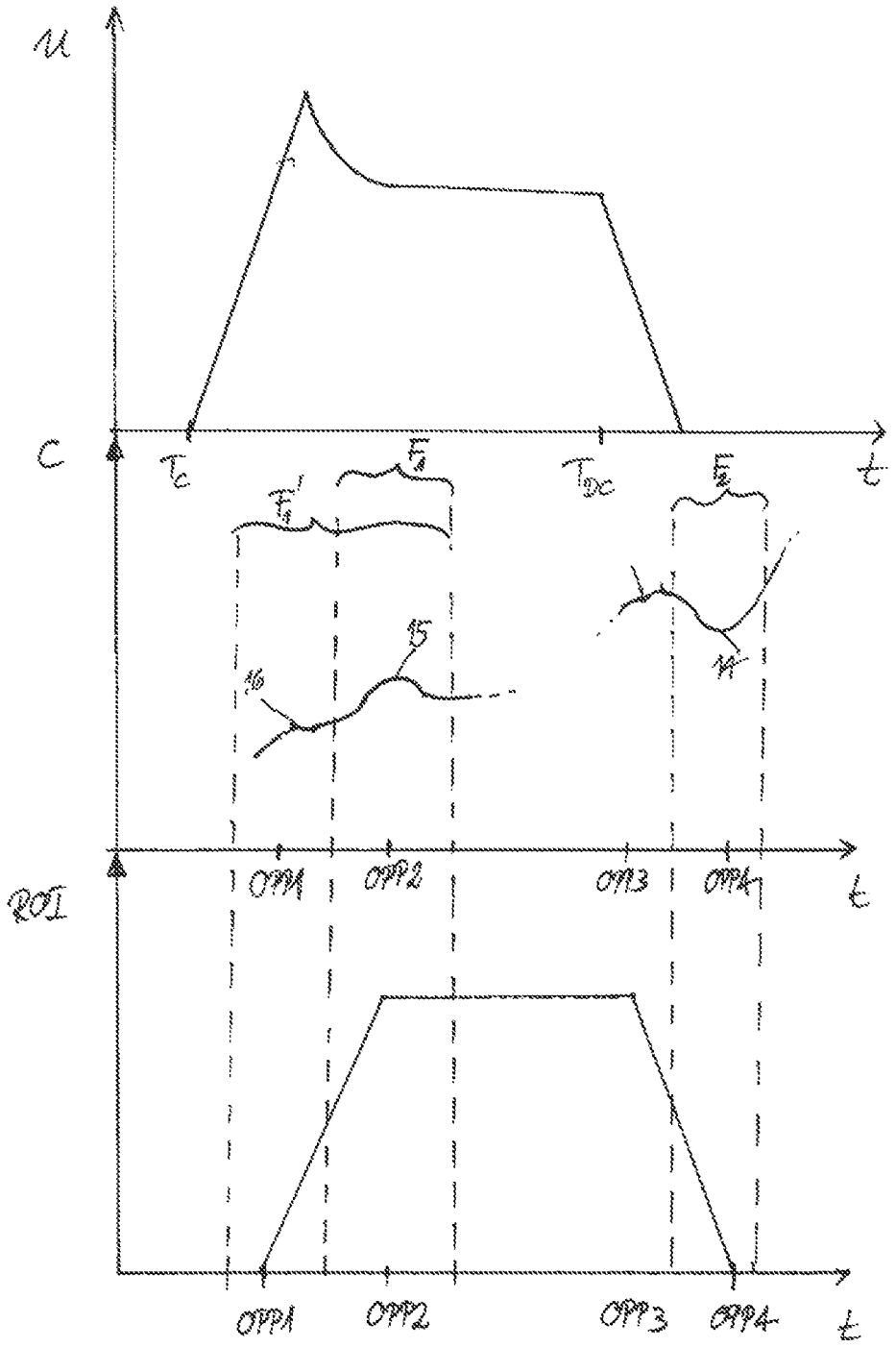
FIG. 4 shows a further signal profile over time, generated by means of a sensor element of an injection system according to an embodiment.

In the example shown in FIG. 4, the closure element 6 impacts against the upper stop 9 and is held there for a time period which lasts from OPP2 to OPP3. Both the closing time OPP4 and the opening time OPP2 are used as control variables here.

In the method step S2, control errors are determined from a preceding injection cycle, such as, for example, the difference between the setpoint closing time and the measured actual closing time (setpoint-OPP4–actual-OPP4) and, if appropriate, the difference between the setpoint opening time and the measured actual opening time (setpoint-OPP2–actual-OPP2).

In the method step S3, correction values for pilot control values of the control vector (pilot-control vector) are subsequently determined with a PI controller 11 of the control unit 1 as a function of the control errors calculated by means of the computing unit 10. These pilot control values are read out in step S4 from a pilot-control characteristic diagram, stored in a data memory 12 of the control unit 1, as a function of, in particular, the setpoint values of the times OPP2 and/or OPP4. In step S5, the specific correction values of the PI controller 11 are added to the pilot-control vector using the computing unit 10. This results in the actual value of the control vector for the instantaneous injection cycle.

In the example shown in FIG. 3, this control vector can contain the time of the start of charging $T_c$, the charging period $t_c$ and the strength of the charging current $I_c$. In the example shown in FIG. 4, the control vector can additionally contain the time of the start of discharging $T_{DC}$ and the strength of the discharging current $I_{DC}$.

In the method step S6, control signals corresponding to the instantaneous actual value of the control vector are generated by means of an output stage 13 of the control unit 1 and are transmitted to the actuator 4 of the injection valve. In the example shown in FIG. 4, that is to say, at the time $T_c$, the piezo element 5 is charged with the charging current strength $I_c$ for the charging period $T_c$ and subsequently discharged again at the time $T_{DC}$ with the discharging current strength $I_{DC}$ for the discharging time period $T_{DC}$. This charging/discharging process leads to an expansion and contraction of the piezo element, by means of which the described movement of the closure element from the closed position and back into it is triggered.

In the described exemplary embodiment, the piezo element 5 of the actuator 4 is used at the same time as a sensor element 7 with which the movement of the closure element 6 is detected and measured. In this context use is made of the fact that the closure element triggers a characteristic signal, that is to say the opening signal or the closing signal, at the actual opening time (=OPP2, see FIG. 4) at which it impacts against the upper stop 9, and at the actual closing time (OPP4, see FIGS. 3 and 4) at which it impacts in the closed position 9.

These characteristic signals may be, for example, fluctuations in one or more electrical measurement variables which describe the instantaneous state of the piezo element 5. These measurement variables are in the present case an electrical voltage U which is tapped at the piezo element 5 or the sensor element 7 and/or a current strength which is tapped at the piezo element 5 or the sensor element 7, and also, as in the example 4, an electrical capacitance C, derived therefrom, of the piezo element 5 or sensor element 7. The signal profiles over time of the sensor element 7, that is to say the profiles of these measurement variables over time, are evaluated by means of the control unit 1 as described in the text which follows.

Firstly, parts of the signal profiles over time which are contained within one of one or more search windows F, F1, F1', F2 of the injection cycle are stored by means of the data memory 12 and subsequently examined for the presence of the characteristic signals by means of the computing unit 10. In the example shown in FIG. 3, precisely one such time search window F is provided in each injection cycle, said time search window F being selected in such a way that it contains the setpoint closing time (OPP4). In contrast, in the example shown in FIG. 4, two time search windows F1 and F2 are provided, wherein the search window F1 contains the setpoint opening time (OPP2). (Alternatively, the opening time window F1' which is also illustrated in FIG. 4 and which also contains the setpoint time (OPP1) could also be selected). The second search window F2 is separated from the first search window F1 and contains the setpoint closing time OPP4. The storage of the specified parts of the signal profiles and the evaluation thereof are carried out in the method step S7.

In the exemplary embodiment shown in FIG. 3, the characteristic signal 14 is, in particular, a fluctuation of the voltage U tapped at the sensor element 7, in the form of a local maximum in the simplified example shown. In the exemplary embodiment which is shown in FIG. 4, the characteristic signals 14, 15 are, in particular, fluctuations in the capacitance C of the sensor element 7 or of the piezo element 5. In the simplified example shown, the characteristic signals in the search window F2 are a local minimum 14 of the capacitance C, and in the search window F1 they are a local maximum of the capacitance C, and in the case of the search window F1' they are also a further local maximum 16 (characteristic of the time OPP1).

In the following method step S8, a differentiation between cases is performed, wherein the method is continued with the method step S9 if the characteristic signals (the characteristic signal 14 in the example shown in FIG. 3 or the characteristic signals 14 and 15 in the example shown in FIG. 4) could be detected. Otherwise, that is to say in the case of a control loss, a searching method is carried out which starts with the method step X1.

In the method step S9, the actual closing time (OPP4) of this injection cycle is acquired on the basis of the characteristic signal 14, and also in the case of the exemplary embodiment shown in FIG. 4 the actual opening time (OPP2) is also acquired on the basis of the characteristic signal 15. Furthermore, in the method step S9 an iterator n is set to the value "0". The function of the iterator n will be explained below in more detail in relation to the searching method.

Subsequently, the next injection cycle of this injection valve 2 is started with the method step S1. In this context, recourse can be made to the actual closing time which is acquired in the method step S9 and stored in the data memory 12 of the control unit, and to the actual opening time (OPP2) which has possibly also been acquired, in particular during the acquisition of the control error and the determination of the actual value of the control vector in the subsequent method steps S2 to S5.

In the event of the searching method being carried out, in the method step X1 the iterator n, which can assume the value of an integer greater than or equal to "0", is increased by 1. At the start of the searching method, the iterator is set from the value "0" to the value "1". In the subsequent step X2, the value of the iterator n is checked. If the iterator n has exceeded a defined threshold value $n_{max}$, an abort criterion of the searching method or of the control method is therefore satisfied, with the result that the method step X6, which constitutes an emergency running program of the injection system, is carried out. If the abort criterion is not satisfied and the iterator has the value 1, the method step X3 is carried out, and if the abort criterion is not satisfied and the iterator has a value greater than 1, the method step X4 is carried out directly after the method step X2.

In the method step X3 of the searching method, a starting value $S_{start}$ for the manipulated variable or starting values for components of the actuating vector of this injection valve are defined. For the starting value $S_{start}$ various definitions are possible. For example, the actual actuating value $S_{act}$ of the manipulated variable of a preceding injection cycle of this injection valve 2 can be used as a starting value $S_{start}$ of the searching method, for example of the last injection cycle of this injection valve 2 at which the characteristic signals 14, 15 were last detected (for example in the preceding method step S7 during subsequent storage in the method step S9 in the data memory 12 of the control unit 1). It is also possible for the starting value of the searching method to correspond to a reference calibration of the injection valve 2, which is permanently predefined for this valve. Such a reference calibration can be stored, for example, in the data memory 12 of the control unit 1. This reference calibration may be a reference characteristic diagram from which the starting value $S_{start}$ can be read out as a function of an instantaneous working point of the injection valve 2 or of the internal combustion engine 3, for example by means of the computing unit 10. It is also possible for the starting value $S_{start}$ of the searching method to be acquired taking into account, and/or as a function of, actual values of manipulated variables or actuating vectors of the other injection valves 2 of the injection system. For example, these actual values can also be stored in the data memory 12 and are associated, for example, with preceding injection cycles of these further injection valves 2 (typically each acquired in the method steps S7 and stored in the data memory 12 in the method step S9 of the control circuits of these injection valves). For example, a mean value of these actual values of the manipulated variables or of the respective components of the actuating vectors of these further injection valves 2 can be formed by means of the computing unit 10, and the starting value $S_{start}$ of the searching method can be determined on the basis of this mean value, for example as this mean value.

In the following method step X4, an incremental value (or an increment vector) $I_n$ is acquired and added to the starting value $S_{start}$ in the subsequent method step X5. This sum of the starting value $S_{start}$ and of the incremental value $I_n$ serves in the following method step S9 as a current manipulated variable $S_{act}$ for actuating the actuator 4 by means of the output stage 13 of the control unit 1, as already described above. Therefore, the following applies in each case $S_{act}=S_{start}+I_n$, cf. FIG. 5. In the present case, in which the manipulated variable is a multi-dimensional actuating vector, there is provision that only one component of the actuating vector is varied in the searching method, while the actual values of the other components of the actuating vector are not changed. Accordingly, the increment vector has precisely one non-negligible entry. For example, this component is the charging current strength $I_c$, the charging time $T_c$, the discharging time $T_{DC}$, the charging period $T_c$ or the discharging period $T_{DC}$. In addition there is provision that in the case of a loss of the opening signal a different component of the control vector is varied than in the case of a loss of the closing signal. Therefore, the searching method in the case of the loss of the opening signal (first searching method) differs from the searching method in the case of the loss of the closing signal (second searching method).

In one alternative embodiment, during the searching method a plurality of components of the actuating vector are varied, such as for example the charging current strength and the charging period, as has already been described above. The increment vector then typically has two or more non-negligible components.

Subsequently, in the method step S7 and S8 it is checked, as described above, whether the characteristic signals can be detected and, if this is the case, the control method is carried on with the method step S9. If this is not the case, the searching method is continued with the method step X1.

Figure 5:
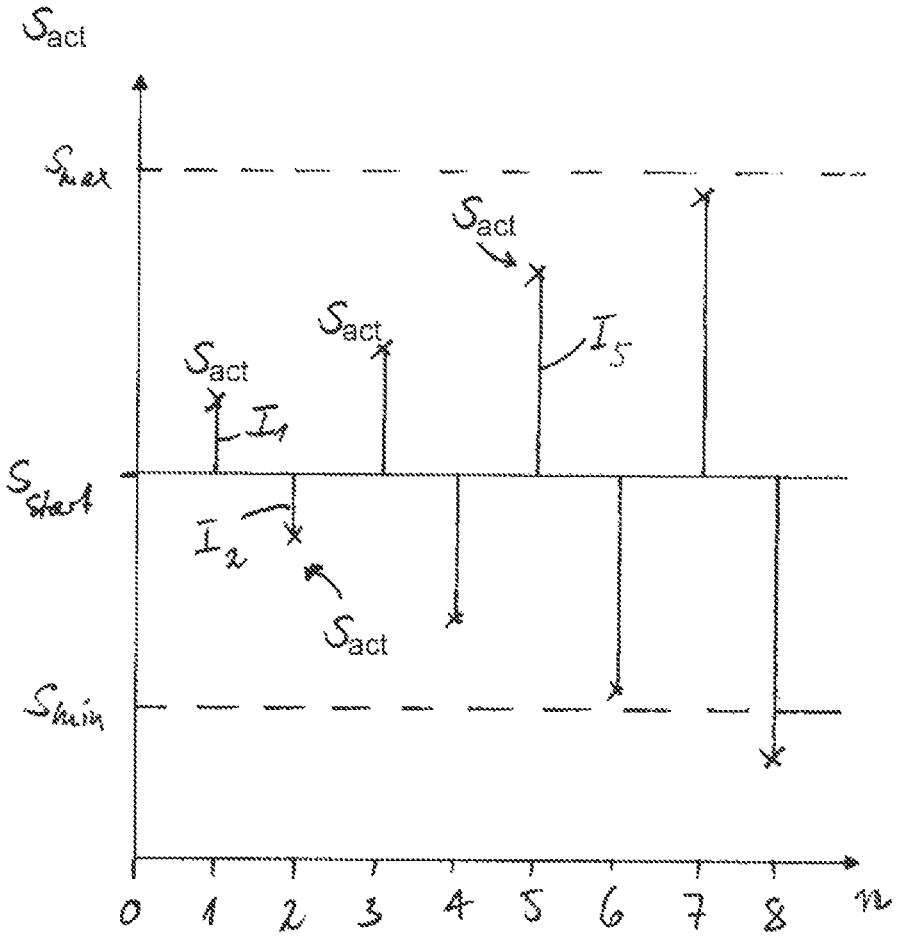
FIG. 5 shows actual values of a control variable during the execution of a searching method of a control method according to an embodiment.

As is apparent from FIG. 5, in each of the injection cycles precisely one incremental value (or increment vector) $I_n$ is generated during the searching method, and exclusively this value is respectively added to the starting value. The absolute values of the incremental values $I_n$ or of the (single) non-negligible component of the incremental vector increase strictly monotonously with the value n of the iterator n in the example shown. In addition, the incremental values or the (single) non-negligible components of the increment vectors change their signs according to $(-1)^n$. Alternatively, this sign changes could, however, also occur less often, or the sign changes could in principle also be completely dispensed with, as has been described above. Alternatively, a merely monotonous increase, in absolute terms, in the incremental values or the (single) non-negligible components of the increment vectors could also be provided.

In the method step X5, it is additionally checked as a further abort criterion whether the components of the actual value of the control vector or whether that component of the actual value of the control vector which is varied in the searching method, such as, for example, the charging current strength $I_c$, the charging time $T_c$, the discharging time $T_{DC}$, the charging period $T_c$ or the discharging period $T_{DC}$ undershoots a predefined threshold value or exceeds a predefined further threshold value, see $S_{max}$ and $S_{min}$ in FIG. 5. If this is the case, the method step X7 which contains an emergency running program is carried out.

What is claimed is:

1. A control method for an injection system having at least one injection valve for injecting fuel into an internal combustion engine, the control method including:

actuating the injection valve to move a closure element of the injection valve in recurring injection cycles, wherein the actuation of the injection valve is a function of an actual value of a manipulated variable, the closure element achieving a triggering event, the triggering event comprising either the closing element impacting against an upper stop at an actual opening time or the closing element experiencing a closing impact in a closed position at an actual closing time, wherein the triggering event triggers a characteristic signal of a sensor element of the injection valve, during at least one of the injection cycles, detecting a signal profile of the sensor element over time, and analyzing a specified part of the signal profile that is contained in a time search window of the injection cycle for the presence of the characteristic signal, wherein the time search window of the injection cycle is selected such that it contains either an expected opening time at which the impacting of the closure element against the stop is expected, or an expected closing time at which the closing impact of the closure element in the closed position is expected, if the characteristic signal is detected in the specified part of the signal profile:

determining either the actual opening time or the actual closing time of the injection cycle based on the characteristic signal, and determining the actual value of the manipulated variable of the injection valve for a subsequent injection cycle as a function of the acquired actual opening time or actual closing time, and if the characteristic signal is not detected in the specified part of the signal profile over time for this injection cycle, performing a searching method in subsequent injection cycles, including:

defining a starting value for the manipulated variable for the searching method, calculating a new actual value of the manipulated variable for each of the subsequent injection cycles as the sum of the starting value and an incremental value associated with the respective subsequent injection cycle, and increasing an absolute magnitude of the incremental values in each of the subsequent injection cycles during the searching method;

wherein a direction of the incremental values for a subsequent injection changes from an increase to a decrease or from a decrease to an increase during the searching method.

2. The control method of claim 1, wherein the actuator of the injection valve has a drive configured as a piezo element.

3. The control method of claim 2, wherein the sensor element of the injection valve is the piezo element of the actuator of the injection valve.

4. The control method of claim 1, wherein the characteristic signal of the sensor element is a fluctuation in an electrical measurement variable.

5. The control method of claim 1, wherein the manipulated variable is an actuation time of the actuator, a start of charging of the actuator, a start of discharging of the actuator, a charging period of the actuator, a current strength, or a voltage, or contains a combination of a plurality of these variables.

6. The control method of claim 1, wherein the actual value of the manipulated variable of a preceding injection cycle of the injection valve is used as the starting value of the searching method.

7. The control method of claim 1, wherein the starting value of the searching method corresponds to a permanently predefined reference calibration for the injection valve.

8. The control method of claim 1, wherein the starting value of the searching method is determined as a function of actual values of manipulated variables corresponding to further injection valves of the injection system.

9. The control method of claim 8, comprising calculating a mean value of the actual values of manipulated variables of the further injection valves, and determining the starting value of the searching method based on the mean value.

10. The control method of claim 1, further comprising:

for each of the injection cycles, providing a further time search window that is chronologically separated from the search window, wherein the search window is selected such that it comprises the expected opening time of the injection cycle, wherein the further search window is selected such that it comprises the expected closing time of the injection cycle, analyzing a specified further part of the signal profile of the sensor element during this injection cycle for the presence of the characteristic signals, wherein the specified further part of the profile over time is contained in the further time search window of the injection cycle, if the characteristic signals are detected in the specified further part of the signal profile over time, determining the actual closing time of the injection cycle based on the characteristic signal, wherein the actual value of the manipulated value of the injection valve for a subsequent injection cycle is determined as a function of the actual closing time, and if the characteristic signals are not detected in the specified further part of the signal profile over time, performing a further searching method in subsequent injection cycles, wherein the further searching method comprises:

defining a further starting value for the manipulated variable of the injection valve, determining the actual value of the manipulated variable for each of the subsequent injection cycles as the sum of the further starting value and of a further incremental value associated with this subsequent injection cycle, and increasing the further incremental values of the subsequent injection cycles during the further searching method.

11. The control method of claim 10, wherein the mathematical signs of the further incremental values change alternately.

12. The control method of claim 1, wherein the expected opening time is determined as a function of the actual opening time of a preceding injection cycle, or the expected closing time is determined as a function of the actual closing time of a preceding injection cycle.

13. The control method of claim 1, wherein:

the expected opening time is a setpoint opening time or the expected closing time is a setpoint closing time, and the actual value of the manipulated variable is selected such that the actual opening time corresponds with the setpoint opening time or the actual closing time corresponds with the setpoint closing time.

14. An injection system comprising:

at least one injection valve for injecting fuel into an internal combustion engine, wherein the injection valve comprises a closure element for closing the injection valve and an actuator for moving the closure element between an upper stop and a closed position of the closure element, a sensor element in which characteristic signals can be triggered by impacting of the closure element against the upper stop at an actual opening time or by a closing impact of the closure element in a closed position at an actual closing time, a control unit configured to actuate the actuator of the injection valve in recurring injection cycles as a function of an actual value of a manipulated variable, wherein the control unit is configured to analyze, for each of the injection cycles of the injection valve, a specified part of a signal profile of the sensor element for the presence of the characteristic signal, wherein the specified part of the signal profile over time is contained in a time search window of the injection cycle, wherein the time search window is selected such that it contains an expected opening time or an expected closing time, wherein the control unit is configured to determine the actual opening time or the actual closing time of the injection cycle based on the characteristic signal, wherein the control unit is configured such that if the characteristic signal is detected in the specified part of the signal profile over time, the control unit determines the at least one actual value of the at least one manipulated variable of the injection valve for a subsequent injection cycle as a function of the determined actual opening time or the determined actual closing time, wherein the control unit is further configured such that if the characteristic signals are not detected in the specified part of the signal profile, the control unit performs a searching method in subsequent injection cycles, including:

defining a starting value for the manipulated variable for the searching method, calculating a new actual value of the manipulated variable for each of the subsequent injection cycles as the sum of the starting value and an incremental value associated with this subsequent injection cycle, and increasing an absolute magnitude of the incremental values in each of the subsequent injection cycles during the searching method, wherein a direction of the incremental values for a subsequent injection changes from an increase to a decrease or from a decrease to an increase during the searching method.

15. The injection system of claim 14, wherein the actuator of the injection valve has a drive configured as a piezo element.

16. The injection system of claim 14, wherein the sensor element of the injection valve is the piezo element of the actuator of the injection valve.

17. The injection system of claim 14, wherein the characteristic signal of the sensor element is a fluctuation in an electrical measurement variable.

* * * * *